United States Patent [19]

Wilcox

[11] 4,374,632

[45] Feb. 22, 1983

[54] VANE CONTROL FOR A VANE MOTOR

[75] Inventor: Jack W. Wilcox, Columbus, Ohio

[73] Assignee: Abex Corporation, New York, N.Y.

[21] Appl. No.: 230,766

[22] Filed: Feb. 2, 1981

[51] Int. Cl.[3] ..... F04C 2/356

[52] U.S. Cl. ..... 418/267; 418/82

[58] Field of Search ..... 418/267, 268, 82

[56] References Cited

U.S. PATENT DOCUMENTS

| | | | |
|---|---|---|---|
| 2,762,312 | 9/1956 | Adams et al. | 418/267 |
| 2,861,517 | 11/1958 | Neff | 418/82 |
| 3,223,044 | 12/1965 | Adams et al. | 418/82 |
| 3,359,914 | 12/1967 | Adams et al. | 418/1 |
| 3,401,641 | 9/1968 | Adams et al. | 418/82 |
| 3,781,145 | 12/1973 | Wilcox | 418/1 |
| 4,242,068 | 12/1980 | Shaw | 418/82 |

*Primary Examiner*—Ira S. Lazarus

*Attorney, Agent, or Firm*—Thomas S. Baker, Jr.; David A. Greenlee

[57] ABSTRACT

A vane motor which uses two-lip vanes has a fluid restrictor in a fluid passage which connects the inner and outer ends of each vane. High pressure fluid is supplied to the inner end of each vane as it traverses the transfer and sealing zone. This fluid flows through the fluid passage to the outer end of the vane to pressure balance the vane. In the event the outer end of a vane is separated from the cam ring the high pressure fluid at the outer end of the vane flows to the low pressure area and a pressure drop is created across the restrictor which results in a force which biases the vane towards the cam ring.

3 Claims, 8 Drawing Figures

VANE CONTROL FOR A VANE MOTOR

BACKGROUND OF THE INVENTION

This invention relates to an improvement in a vane type hydraulic motor which comprises a rotor, a stator, vane slots in one of the rotor or stator, and vanes in the vane slots which sequentially traverse a high pressure zone, a transfer zone, a low pressure zone and a sealing zone when the motor is operating. More specifically, the invention relates to an improvement which maintains the vanes against the cam ring during the time the vanes traverse the transfer and sealing zones.

Conventional two-lip, solid vanes are well-known in the art and are commonly used in vane motors and pumps. As a vane traverses the transfer and sealing zones on the major and minor diameters respectively of the cam ring, one of the vane faces is exposed to high pressure fluid from the high pressure port while the other face is exposed to low pressure fluid from the low pressure port and the high pressure fluid tends to leak across one of the lips on the vane. This leakage creates a high pressure on top of the vane which tends to bias the vane inwardly of its vane slot and away from the cam ring. Separation of the vane from the cam ring is potentially disastrous, since it provides a short circuit path for high pressure fluid to reach the low pressure zone which is located in front of the vane when the device is acting as a motor.

In a vane motor springs positioned between the bottom of the vane slots and the bottom of the vanes are used to bias the vanes outwardly of the slots and against the cam ring. A problem with using springs to bias a solid vane is that if there is any leakage of high pressure fluid across the top of the vane a large force on top of the vane will result which will overcome the force of the springs and cause the vane to be moved inwardly of its slot away from the cam ring.

To overcome some of the problems associated with a solid two-lip vane, passages are formed in the vane, which passages connect the inner and outer ends of the vane. Such passages are shown in U.S. Pat. No. 3,359,914 to Adams, which is assigned to the assignee of the instant invention. The purpose of the passages as disclosed in the Adams' patent is to equalize or balance the pressure on the inner and outer ends of the vane at all times. Consequently, any fluid which leaks over a lip on the outer edge of the vane cannot cause a force buildup on the outer end of the vane since the inner and outer ends of the vane are connected.

An additional problem arises as a vane in pumps and motors traverses the transfer and sealing zones. In these zones one face of the vane is subjected to high pressure fluid, whereas the opposite face of the vane is exposed to low pressure fluid as mentioned above. The pressure differential which acts on opposite faces of the vane tends to move the vane sideways in its slot and hold it in one position in the slot due to friction. Consequently, if the cam ring moves away from the outer end of a vane a small amount due to manufacturing errors in the cam ring or due to flexure of the housing caused by pressure differences arising from the pumping action, a large force on the inner end of the vane is required to move the vane back into contact with the cam ring. Separation of a vane from the cam ring in the transfer and sealing zones is generally avoided in a vane pump by the use of a hydraulically operated piston which applies substantial pressure to the inner end of a vane in the transfer and sealing zones. The operation of a hydraulically operated piston can be seen in U.S. Pat. No. 3,223,044 which is assigned to the assignee of the instant invention. However, a hydraulic piston is generally not suitable for use in a vane motor. The reason is that in a motor the piston would be energized or biased upwardly in the major diameter portion of the cam ring which means the piston must travel a relatively long distance before it contacts the vane or before the vane contacts the cam ring which would cause excessive noise. In a pump the piston is energized in the minor diameter portion of the cam ring which means the piston travels a short distance before it contacts the vane and the noise is not excessive.

Separation of a vane from the cam ring in vane motors is due to the fact that springs are interposed between the bottom of the vane slot and the inner end of the vane to bias the vane outwardly of its slot into contact with the cam ring. However, due to size and space limitations the force of the springs is substantially less than the force of a hydraulically operated pin in a vane pump and the force of the springs is not sufficient to maintain the vane in contact with the cam ring as the vane traverses the transfer and sealing zones, particularly at low speeds. Consequently, the leakage rate of a vane motor is quite high and its efficiency is quite low.

It is desirable to provide a vane motor in which the vanes remain in contact with the cam ring as they traverse the transfer and sealing zones.

Also, it is desirable to provide a means for maintaining the vanes in contact with the cam ring which uses a minimum of force.

It is further desirable that the means for maintaining the vane in contact with the cam ring operates only in the areas of the transfer and sealing zones.

Moreover, it is desirable that the force exerted by the means for maintaining the vane in contact with the cam ring modulates in such a way that the force acting to bias the vane outwardly of the vane slots increases as the distance between the outer end of the vane and the cam ring increases.

SUMMARY OF THE INVENTION

The instant invention provides a vane motor in which each two-lip vane has a fluid passage which connects the inner and outer ends of the vane and a flow restricting orifice is in the fluid passage. Additionally, high pressure fluid is supplied to the inner end of each vane as it traverses the transfer and sealing zones. The high pressure fluid at the inner end of the vane flows through the fluid passage to the outer end of the vane to pressure balance the vane. In the event the outer end of a vane separates from the cam ring the high pressure fluid at the outer end of the vane flows to the low pressure area and a pressure drop is created across the orifice which results in a force which tends to bias the vane outwardly of the vane slot. As the distance between the outer end of the vane and the cam ring increases more high pressure fluid flows through the orifice which causes a greater pressure drop across the orifice and increased pressure biasing the vane outwardly of its slot. Similarly, as the distance decreases less fluid flows through the orifice which lowers the pressure drop and decreases the force biasing the vane outwardly.

DESCRIPTION OF THE PREFERRED EMBODIMENT

Figure 1:
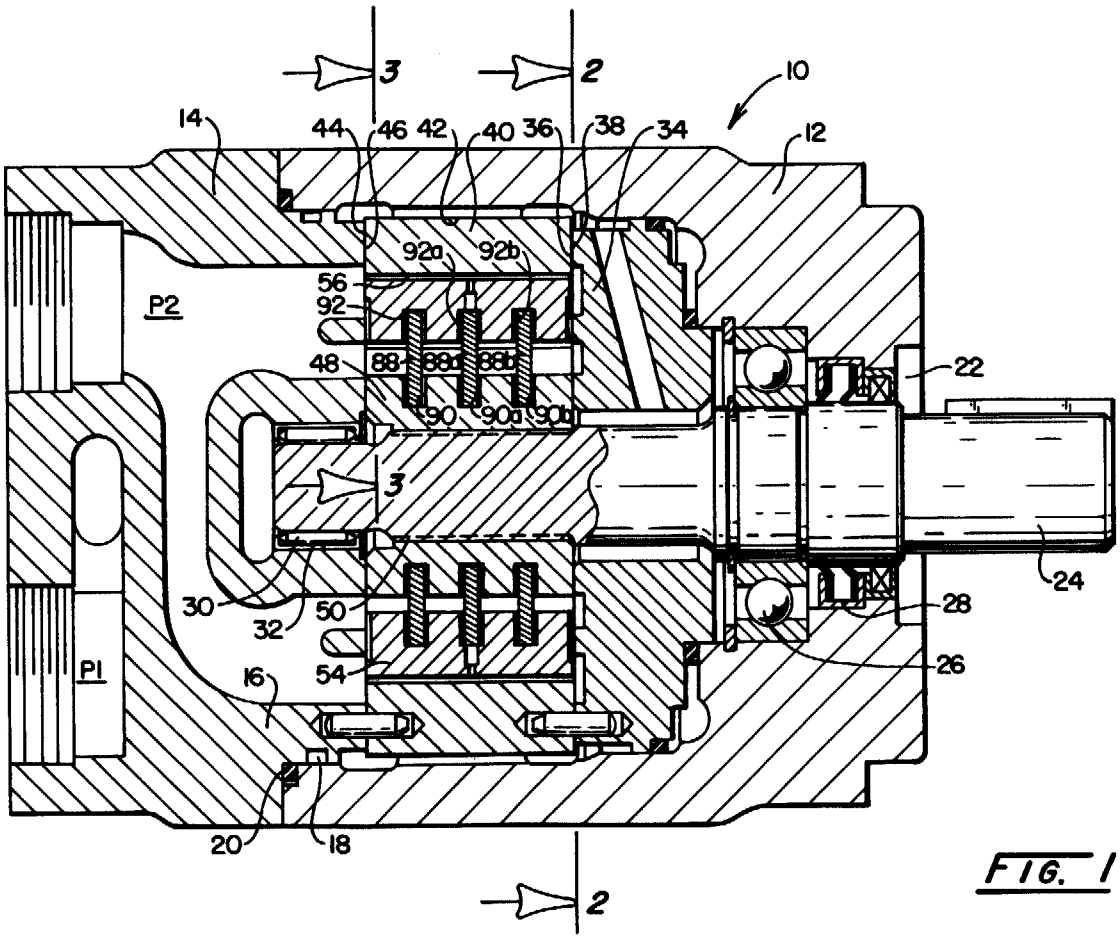
FIG. 1 is an axial section of the vane motor of the instant invention.
Figure 2:
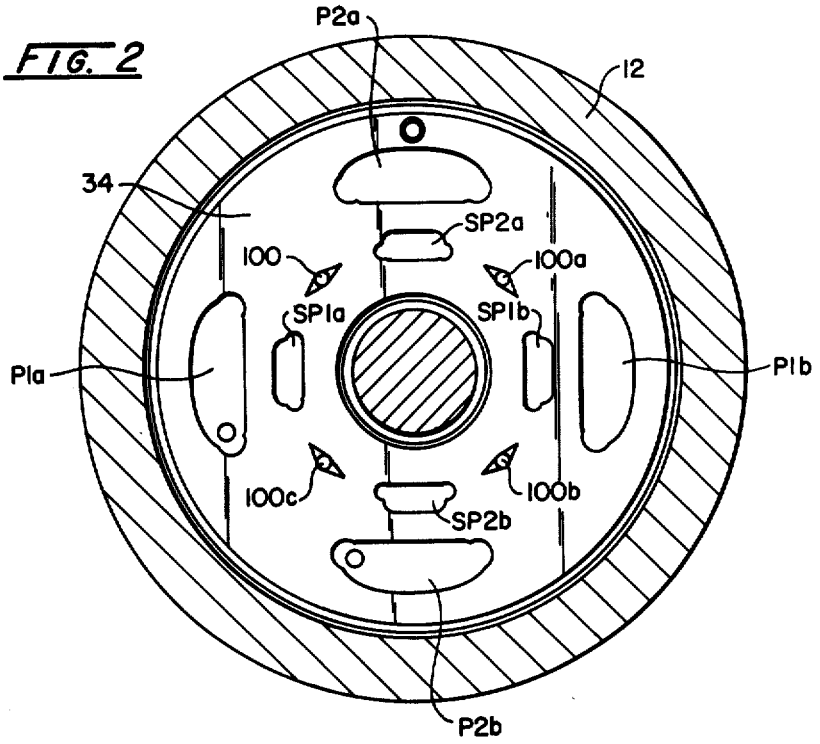
FIG. 2 is a transverse sectional view taken along line 2—2 of FIG. 1 showing the port plate.

Referring to FIGS. 1 and 2, the vane motor 10 of the instant invention includes a housing formed by the co-operation of a main body casting 12 and a port cap 14. Port cap 14 has an annular projection 16 which is received in a mating bore 18 in one end of body 12 and is sealed with respect to body 12 by an O-ring 20. Port cap 14 is secured to body 12 by bolts, not shown.

Body 12 has a central opening 22 which receives a drive shaft 24. Drive shaft 24 is supported for rotation in body 12 by a bearing 26 which is secured against axial movement. A seal 28 prevents fluid leakage along shaft 24. Drive shaft 24 projects through the main portion of body 12 and is supported at its outer end by a bearing 30 which is mounted in a bore 32 formed in the central portion of port cap 14.

A cheek or port plate 34 is supported in body 12. Port plate 34 has a smooth, flat inner surface 36 which bears against one side 38 of an annular cam ring 40, which is supported in a central annular rib 42 in body 12. The opposite side 44 of cam ring 40 bears against a smooth, flat surface 46 formed on the inner surface of port cap 14.

Figure 3:
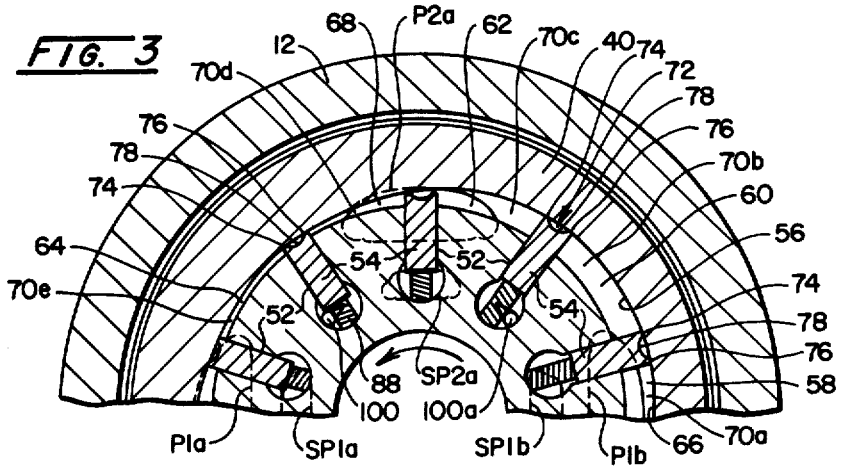
FIG. 3 is a transverse sectional view taken along line 3—3 of FIG. 1.
Figure 4:
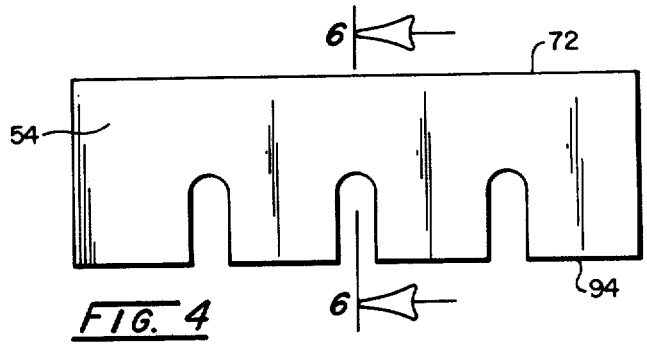
FIG. 4 is a side elevational view of an improved vane of the instant invention.
Figure 6:
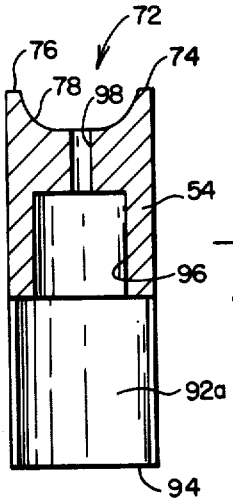
FIG. 6 is a sectional view taken along line 6—6 of FIG. 4.
Figure 5:
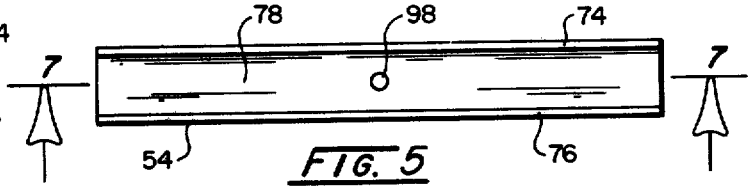
FIG. 5 is a top plan view of the vane of FIG. 4.

The vane motor 10 has a pair of fluid passages P1, P2 formed in port cap 14, each of which is in fluid communication with pairs of opposing ports P1*a*, P1*b* and P2*a*, P2*b*, respectively, formed in port plate 34. Inside of cam ring 40 is a rotor 48 which is driven by drive shaft 24 through a spline connection 50. The rotor 48 has a plurality of slots 52 each of which receives a vane 54, as shown in FIG. 3.

Cam ring 40 has a smooth inner surface 56 that is contoured to provide a symmetrical motor construction. In vane motor 10 one of the pairs of ports P1*a*, P1*b* or P2*a*, P2*b* has high pressure fluid which is received from its respective port P1, P2 in port cap 14 and the other pair of ports P1*a*, P1*b* or P2*a*, P2*b* is a low pressure port. Referring to FIG. 3, for each 180° of counterclockwise rotor rotation, each vane 54 sequentially traverses a pressure zone 58, a transfer zone 60, a low pressure or exhaust zone 62 and a sealing zone 64. Cam surface 56 recedes from the rotor 48 in the high pressure zone 58 forming an outward ramp 66 which terminates at the greatest distance from the rotor 48 which is the beginning of the transfer zone 60. The transfer zone 60 is formed on the major diameter of the cam ring 40. At the end of the transfer zone 60 the cam ring surface 56 moves towards rotor 48, forming an inward ramp 68 which terminates at the closest distance from the rotor 48 at the sealing zone 64. The sealing zone 64 is formed on the minor diameter of cam ring 40.

Pairs of adjacent vanes divide the annular pumping space between the rotor 48, cam ring surface 56, port plate 34 and flat surface 46 on port cap 14 into a series of intervane pockets or spaces which are designated 70*a*, 70*b*, 70*c*, 70*d*, 70*e*.

The two high pressure ports P1*a* and P1*b* which are connected to high pressure port P1 in port cap 14 are diametrically opposed in port plate 34. These ports are located circumferentially approximately 90° from the low pressure ports P2*a* and P2*b* which are connected to low pressure port P2 in port cap 14. Each of the ports P1*a*, P1*b*, *l P2a*, P2*b* is in fluid communication with a small port SP1*a*, SP1*b*, SP2*a*, SP2*b*, respectively, positioned radially inwardly of it and aligned with the bottom of the vane slots 52.

Figure 7:
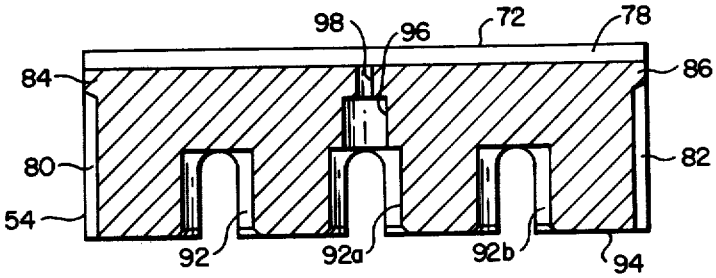
FIG. 7 is a transverse sectional view taken along line 7—7 of FIG. 5.

In FIG. 3 where the indicated direction of rotation is counterclockwise, the outer end 72 of each vane 54 has a leading lip or edge 74 and a trailing lip or edge 76, which edges are separated by a top groove 78. Groove 78 is isolated from grooves 80, 82 formed in the sides of each vane 54 by projections 84, 86, as best seen in FIG. 7. The projections 84, 86 seal against port surface 36 and port cap surface 46 to prevent leakage of the fluid from groove 78. During operation of the motor 10, one of the edges 74, 76 is in contact with the smooth inner surface 56 of cam ring 40 at all times. When vane 54 traverses outward ramp 66 in the high pressure zone 68 trailing lip 76 is in contact with surface 56, whereas leading lip 74 is in contact with inner surface 56 when vane 54 traverses inward ramp 68 in the low pressure zone 62. In the transfer and sealing zones 60, 64 respectively, both of the vane lips 74, 76 engage the cam ring surface 56 since the diameter of the cam ring surface 56 is constant in these areas.

In the instant invention each vane 54 is biased outwardly of its slot 52 by three springs 88, 88*a* and 88*b* which are located in bores 90, 90*a*, 90*b*, respectively, formed in rotor 48 and bores 92, 92*a*, 92*b*, respectively, in the vane 54. The springs 88, 88*a*, 88*b* act against the inner end 94 of the vane 54 to bias the outer end 72 against cam surface 56. Referring to FIGS. 4–7, each vane 54 has a central bore 96 which connects the inner and outer ends 94, 72, respectively. The bore 96 has a fluid restricting orifice 98 adjacent the outer end 72 of the vane. The purpose of orifice 98 is to create a force which acts to maintain the vane 54 against the inner cam surface 56 when the vane 54 is in the transfer or sealing zones 60, 64, respectively, as will now be described.

Referring to FIG. 3, it can be seen that when a vane 54 is in a low pressure zone 62 or a high pressure zone 58 both sizes of the vane 54 are exposed to the same pressure and the leading and trailing lips 74, 76 are at the same pressure. Also, the inner and outer ends of the vane 94, 72 respectively are connected through bore 96 so they are at the same pressure. Consequently, there is no high fluid force acting on the outer end 72 tending to move the vane 54 inwardly of slot 52 away from cam surface 56. Thus, in the high and low pressure zones 58, 62 the springs 88, 88*a*, 88*b* are sufficient to maintain the outer end 72 of vane 54 in contact with cam ring surface 56. However, during the time a vane 54 traverses either the transfer or sealing zones 60, 64, respectively, one side of the vane 54 is subjected to high pressure fluid while at the same time the other side of the vane 54 is subjected to low pressure fluid. This pressure differential across vane 54 tends to move the vane 54 sideways in its slot 52 and hold the vane in one position in the slot 52 due to friction.

In the instant invention high pressure fluid is supplied to a plurality of bores 100, 100*a*, 100*b*, 100*c* in port plate 34 intermediate the high pressure and low pressure ports P1*a*, P1*b* and P2*a*, P2*b* and centered in the transfer and sealing zones 60, 64. As a vane 54 traverses one of these zones the bottom of its vane slot 52 is aligned with one of the bores 100–100*c* which contain high pressure fluid and high pressure fluid is supplied to the inner end of the vane 54. The high pressure fluid flows through bore 96 and orifice 98 into outer groove 78 to thereby provide equal pressure at the inner and outer ends 94, 72, respectively. So long as the lips 74, 76 engage surface 56 no fluid escapes from groove 78 since it is isolated from the vane side grooves 80, 82, as mentioned above. In the event the outer end 72 of the vane 54 is separated from the cam ring surface 56 the high pressure fluid on the outer end 72 escapes over one of the lips 74, 76 to the low pressure zone. This reduced pressure on the outer end 72 of vane 54 causes high pressure fluid to pass through bore 96 and orifice 98. As the fluid flows through the orifice 98 a pressure differential across the orifice 98 is created and an upward force acts to bias vane 54 outward of its slot 52. This upward force acts in conjunction with the springs 88, 88*a* and 88*b* to move the vane 54 against the cam ring surface 56.

Figure 8:
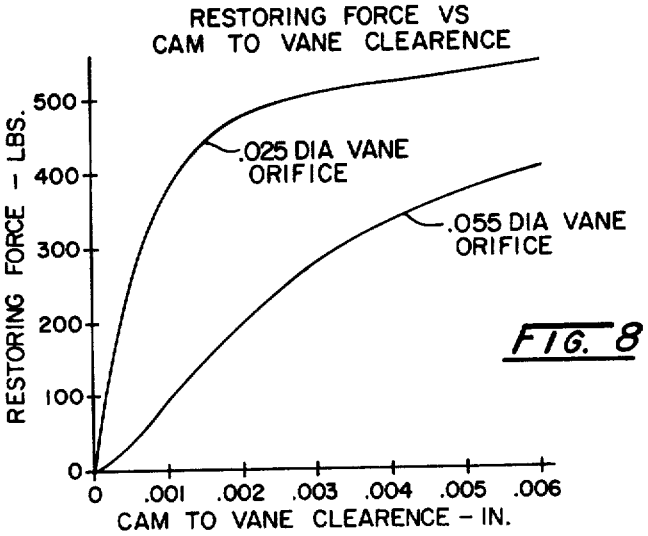
FIG. 8 is a graph showing the relationship between restoring force on the bottom of the vane and clearance between the vane and cam ring.

Referring to FIG. 8, it can be seen that a substantial force is developed by the pressure differential caused by the flow of high pressure fluid through orifice 98 and this force increases as the clearance between the lips 74, 76 of vane 54 and the cam surface 56 increases, and decreases as the clearance between the lips 74, 76 and surface 56 decreases. This results because the pressure drop is proportional to the flow rate of the high pressure fluid and the flow rate is proportional to the clearance. In other words, the upward force acting on vane 54 is modulated by the clearance between the cam surface 56 and the outer end 72 of vane 54. When the lips 74, 76 engage the inner surface 56 of the cam ring there is no fluid flow through orifice 98 to cause a pressure differential and thus there is no fluid force acting to bias the vane 54 outwardly. It has been found that by changing the diameter of orifice 98 the force exerted by the pressure differential across the vane 54 can be changed until a suitable force is established. A suitable force is one which maintains the outer end 72 of vane 54 in contact with inner surface 56 but is not sufficient to cause excessive wear on either the cam ring surface 56 or the lips 74, 76 of the vane 54.

Although a preferred embodiment of the invention has been illustrated and described, it will be apparent to those skilled in the art that various modifications may be made without departing from the spirit and scope of the present invention.

I claim:

1. In a vane motor having: a rotor member; a stator member; a cam surface formed on one of the members; a plurality of vane slots formed in the other member; a vane in each slot for movement relative thereto and having a first face, a second face, an inner end, an outer end, a first side, a second side, a first sealing lip on said outer end adjacent the first face, a second sealing lip on said outer end adjacent the second face, an outer groove formed between the first and second sealing lips; a first bore connecting said inner end and said outer end; said bore opening into said outer groove, said bore having a fluid restrictor therein which causes a pressure drop when fluid flows through the restrictor; said rotor and stator members cooperating with a pair of port plates to provide a high pressure zone, a transfer zone, a low pressure zone and a sealing zone; said vanes sequentially traversing said high pressure zone, transfer zone, low pressure zone and sealing zone; the improvement comprising means for preventing pressure fluid in the outer groove from leaking down the first and second sides of the vane and means for supplying high pressure fluid to the inner end of a vane as it traverses one of the transfer or sealing zones such that when the outer end of the vane is separated from the cam surface, the high pressure fluid which is supplied to the inner end of the vane flows through the restrictor to the outer end of the vane and over the one of the first or second sealing lips which is in fluid communication with low pressure fluid such that a pressure drop is created across the restrictor which results in a force that acts to bias the vane outwardly of its slot and into contact with the cam surface.

2. In a vane motor as recited in claim 1, including means for supplying high pressure fluid to the inner end of a vane as it traverses both the transfer and sealing zones.

3. In a vane motor as recited in claim 1, including first and second side grooves formed in the first and second sides of the vane respectively and the first and the second side grooves are isolated from the outer groove.

* * * * *